US008249435B2

(12) United States Patent
Rookstool

(10) Patent No.: US 8,249,435 B2
(45) Date of Patent: Aug. 21, 2012

(54) PORTABLE HEATING ASSEMBLY

(76) Inventor: James Rookstool, Grand Island, NE (US)

( * ) Notice: Subject to any disclaimer, the term of this patent is extended or adjusted under 35 U.S.C. 154(b) by 587 days.

(21) Appl. No.: 12/534,506

(22) Filed: Aug. 3, 2009

(65) Prior Publication Data

US 2010/0178041 A1 Jul. 15, 2010

Related U.S. Application Data

(60) Provisional application No. 61/143,968, filed on Jan. 12, 2009.

(51) Int. Cl.
*F24D 15/02* (2006.01)
*F24D 15/00* (2006.01)

(52) U.S. Cl. ..... 392/365; 392/347

(58) Field of Classification Search ..... 392/347–378
See application file for complete search history.

(56) References Cited

U.S. PATENT DOCUMENTS

| | | | | |
|---|---|---|---|---|
| 6,169,851 | B1 * | 1/2001 | Naughton et al. | 392/378 |
| 6,285,829 | B1 * | 9/2001 | Smith | 392/390 |
| 6,810,205 | B2 * | 10/2004 | Kaplanis et al. | 392/422 |
| 7,013,080 | B1 * | 3/2006 | Kaplanis et al. | 392/422 |
| 7,539,401 | B2 * | 5/2009 | Takai et al. | 392/407 |

* cited by examiner

*Primary Examiner* — Daniel L Robinson
(74) *Attorney, Agent, or Firm* — Suiter Swantz pc llo

(57) ABSTRACT

A device may include a housing defining a generally nonlinear path between an intake port for taking in fluid and an outlet port for outputting heated fluid. The device may also include a fan assembly disposed of the intake port for supplying the intake port with the fluid. Additionally, the device may also include a heat source disposed along the generally nonlinear path for heating the fluid supplied by the fan assembly. Further, the device may also include a compression assembly for at least partially defining the generally nonlinear path. The compression assembly may be configured for creating a first pressure region proximal to the intake port and a second pressure region distal to the intake port. The first pressure region may be a higher fluid pressure than the second pressure region.

20 Claims, 4 Drawing Sheets

PORTABLE HEATING ASSEMBLY

CROSS-REFERENCE TO RELATED APPLICATIONS

The present application claims the benefit under 35 U.S.C. §119(e) of U.S. Provisional Application Ser. No. 61/143,968, filed Jan. 12, 2009, which is incorporated herein by reference in its entirety.

TECHNICAL FIELD

The present disclosure generally relates to the field of heaters, and more particularly to a portable heating assembly.

BACKGROUND

Portable heaters are designed to provide heat to a room or space, either as a primary or supplemental heat source. Portable heaters can generally be easily moved from one space to another.

SUMMARY

A device may include a housing defining a generally nonlinear path between an intake port for taking in fluid and an outlet port for outputting heated fluid. The device may also include a fan assembly disposed of the intake port for supplying the intake port with the fluid. Additionally, the device may also include a heat source disposed along the generally nonlinear path for heating the fluid supplied by the fan assembly. Further, the device may also include a compression assembly for at least partially defining the generally nonlinear path. The compression assembly may be configured for creating a first pressure region proximal to the intake port and a second pressure region distal to the intake port. The first pressure region may be a higher fluid pressure than the second pressure region.

A system may include a housing having an intake port for taking in fluid and an outlet port for outputting heated fluid. The system may also include a generally nonlinear path for fluid flow positioned between the intake port and the outlet port. Additionally, the system may include a fan assembly disposed of the intake port for supplying the intake port with the fluid. Further, the system may include means for heating the fluid supplied by the fan assembly. Additionally, the system may include means for at least partially defining the generally nonlinear path to create a first pressure region proximal to the intake port and a second pressure region distal to the intake port. The first pressure region may be a higher fluid pressure than the second pressure region.

A method may include defining a generally nonlinear path between an intake port for taking in fluid and an outlet port for outputting heated fluid. The generally nonlinear path may be at least partially defined to create a first pressure region proximal to the intake port and a second pressure region distal to the intake port. The first pressure region may be a higher fluid pressure than the second pressure region. The method may also include positioning a fan assembly at the intake port for supplying the intake port with the fluid. Additionally, the method may include positioning a heat source along the generally nonlinear path for heating the fluid supplied by the fan assembly.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
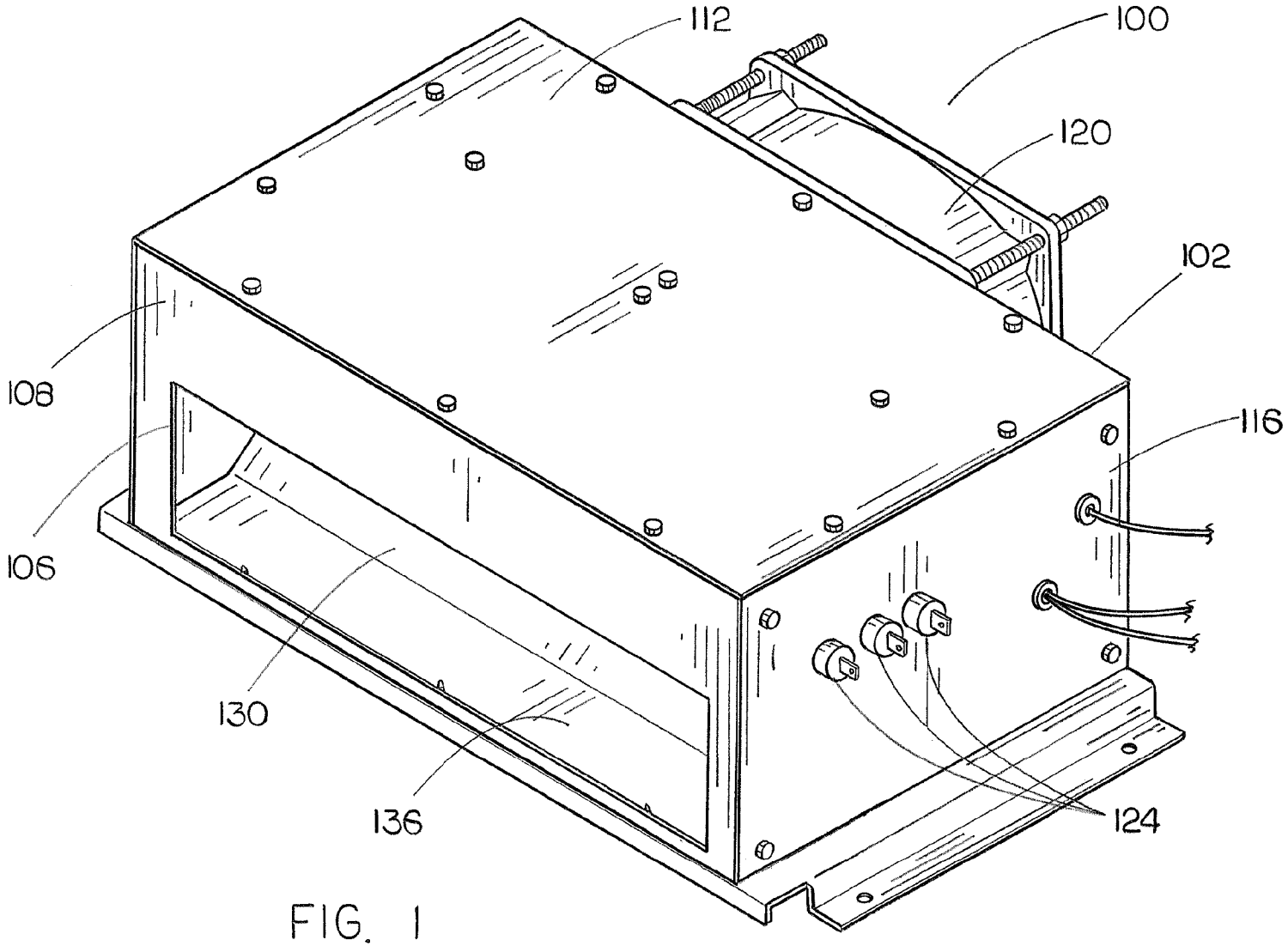
FIG. 1 is an isometric view illustrating a heating assembly in accordance with the present disclosure.
Figure 2:
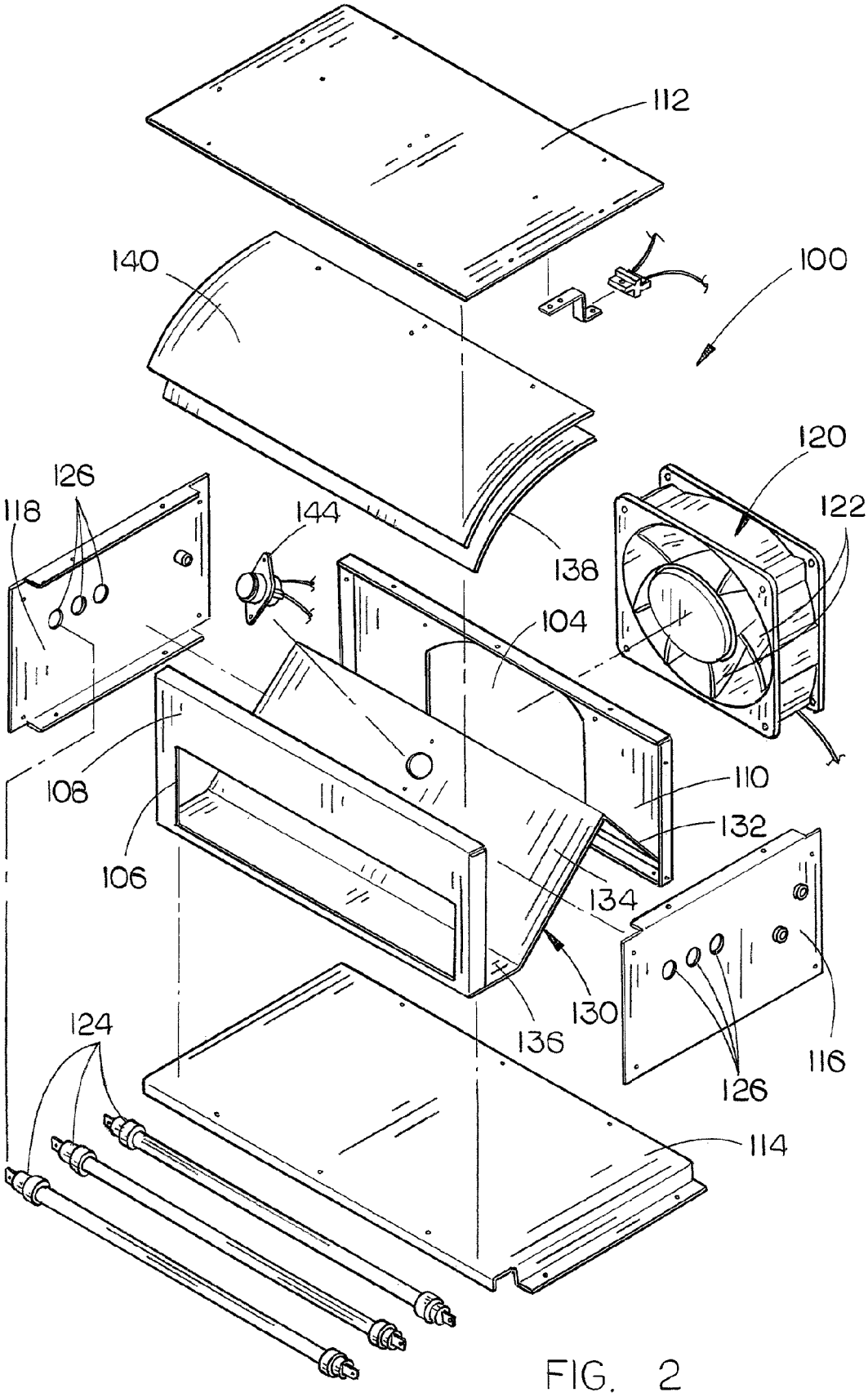
FIG. 2 is an exploded isometric view of the heating assembly illustrated in FIG. 1.
Figure 3:
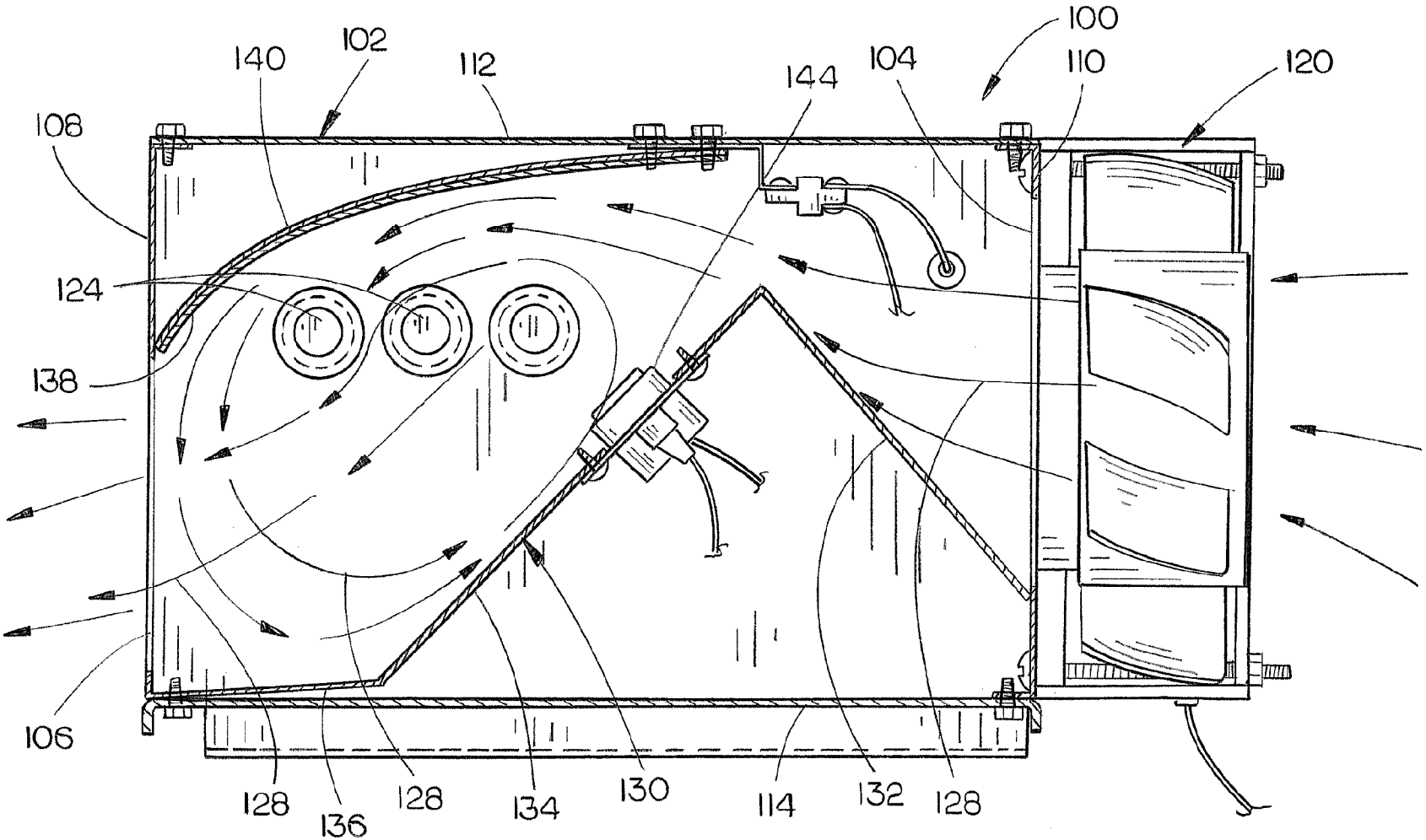
FIG. 3 is a partial cross-sectional side elevation view of the heating assembly illustrated in FIG. 1.

Reference will now be made in detail to the subject matter disclosed, which is illustrated in the accompanying drawings.

Referring generally to FIGS. 1 through 4, a heating assembly 100 is described in accordance with the present disclosure. The heating assembly 100 includes a housing 102 defining an intake port 104 for taking in a fluid (e.g., air) and an outlet port 106 for outputting heated air. The heating assembly 100 may be sized for easy transport and portability. For example, in one embodiment, the housing 102 may be a generally box-like structure, including a front wall 108, a rear wall 110, a top wall 112, a bottom wall 114, and first and second opposing side walls 116 and 118. The top wall 112 may be removable from the housing 102 to provide access to the interior of the housing 102. Alternatively, the top wall 112 may be partially removable (e.g., hinged, latched, or otherwise coupled to at least one of the side walls 116 and 118). The housing 102 may be constructed of metal and/or ceramic materials, as well as any other material(s) capable of withstanding heat generated by the heating assembly 100. While the accompanying figures describe the housing 102 as generally box-like, it is contemplated that other shapes may be utilized as well.

The intake port 104 is positioned in the rear wall 110 of the housing 102. In one embodiment, the intake port 104 may be covered by an intake grill. The intake grill may prevent dust and/or debris from entering the housing 102. The heating assembly 100 includes a fan assembly 120 positioned proximal to the intake port 104 of the housing 102. The fan assembly 120 may comprise a number of electrically-powered, spinning blades 122 utilized to produce airflow through the housing 102, generally from the intake port 104 to the outlet port 106. For instance, the fan assembly 120 may be mounted in the intake port 104 to force air to the interior of the housing 102. In an embodiment, the heating assembly 100 may include a fan switch for selectively disconnecting or restoring electrical power to the fan assembly 120. The fan switch may be mounted to the housing 102 on the rear wall 110, one of the side walls 116 and 118, an interior wall, or in another location, as needed. Further, it is contemplated that the fan switch may be remotely operated.

The housing 102 is configured for at least partially enclosing one or more heat sources 124 and directing air across and/or around the heat sources 124 to provide heated air at the outlet port 106 of the heating assembly 100. In one embodiment, the heat sources 124 may be positioned within the housing 102, near the outlet port 106 of the front wall 108.

Each heat source 124 may comprise a generally elongated, incandescent lamp, mounted within the housing 102 by inserting first and second ends into respective receiving apertures 126 formed within the side walls 116 and 118 of the housing 102. In one embodiment, each heat source 124 may comprise a long wave red quartz infrared lamp, having a length-to-diameter ratio in the range of 5:1 to 15:1 and extending within a cavity generally between the opposing side walls 116 and 118. However, other mounting configurations are contemplated, including cantilevered mounting, where each heat source 124 is connected to one or another of the side walls 116 and 118. While the actual number of heat sources may vary, the present disclosure describes three lamps positioned substantially in parallel within the interior of the housing 102. In one embodiment, wiring may extend to and from the heat sources 124 and may be insulated to a temperature of at least 1200 degrees Fahrenheit (F.).

The interior of the housing 102 may define a generally nonlinear path 128 for airflow through the housing 102. The nonlinear path 128 is at least partially defined by a compression assembly 130 including a first angled wall 132 having a first end coupled to or disposed within a region of the rear wall 110 proximal to the bottom wall 114. The compression assembly 130 further includes a second angled wall 134 including a first end coupled generally perpendicularly to a second end of the first angled wall 132 (e.g., the end of the first angled wall 132 opposite the end coupled to the rear wall 110 of the housing 102). A second end of the second angled wall 134 may either be coupled to the bottom wall 114 of the housing 102, or to a first end of a third angled wall 136. The third angled wall 136 may include a second end coupled to the bottom wall 114 of the housing 102 proximal to the front wall 108.

The angle of the first angled wall 132 and the angle of the second angled wall 134 with respect to the bottom wall 114 are chosen to provide a high pressure region followed by a low pressure region for in-flowing air. For example, the junction of the second end of the first angled wall 132 and the first end of the second angled wall 134 may be generally positioned proximal to a high pressure region for the airflow along the nonlinear path 128. Further, the junction of the second end of the second angled wall 134 and the first end of the third angled wall 136 may be generally positioned distal to the high pressure region. Finally, the remaining length of the third angled wall 136 may be adjacent to a low pressure region for the in-flowing air. In other embodiments, the compression assembly 130 may include at least one curved wall, a continuously formed curved or angled wall (e.g., a sheet of metal bent to form an angle, a semicircle, or a plateau), or may be formed in any other configuration capable creating a high pressure region followed by a low pressure region for in-flowing air.

Thus, in the configuration described above, the angled disposition of first angled wall 132 and the second angled wall 134 from the horizontal with respect to the vertically-oriented side walls 116 and 118 (e.g., the first angled wall 132 and the second angled wall 134 forming one or more ramps within the housing 102) may provide an air pressure differential in the housing 102 with respect to the pressure for air that enters the housing 102. Specifically, in operation, the fan assembly 120 coupled to the exterior of the housing 102 may draw air (e.g., ambient air) into the interior of the housing 102 through one or more inlet openings. The air may flow from the fan assembly 120 and contact the first angled wall 132. As described, the first angled wall 132 is disposed at angle with respect to the bottom wall 114. The air may then flow substantially upward over a high point (junction) formed from the coupling of the first angled wall 132 and the second angled wall 134. The air pressure may increase as the air approaches the space between the junction and the top wall 112. As the air enters the region of the housing 102 where the heat sources 124 are disposed, the air pressure may drop due to the increase in volume in the low pressure region relative to the volume near the junction of the first angled wall 132 and the second angled wall 134.

The nonlinear path 128 may further be defined by a curved, first interior wall 138 coupled to the top wall 112 of the housing 102. The first interior wall 138 may be disposed substantially within the same region of the housing 102 as the second angled wall 134 and the third angled wall 136 (e.g., a first end of the curved, first interior wall 138 may be substantially vertically aligned with the first end of the second angled wall 134, and a second end of the curved, first interior wall 138 may be substantially vertically aligned with the second end of the third angled wall 136 when viewing a side elevation of the housing 102). The first interior wall 138 may be composed of copper or any other metal with like properties. In one specific embodiment, the first interior wall 138 may comprise an approximately 0.4-inch thick copper sheet. The housing 102 may further include a curved, second interior wall 140 coupled to the interior of the housing 102 adjacent to the first interior wall 138 and disposed between the first interior wall 138 and the top wall 112. The second interior wall 140 may act as a heat shield and may be formed from a sheet of metal or a metal alloy (e.g., an aluminum sheet, a galvanized steel sheet, or the like). In one embodiment, the second interior wall 140 may have a thickness of about 0.1-0.4 inches.

It is contemplated that the low pressure region adjacent the third angled wall 136, along with the curved nature of the first interior wall 138, may create a vortex, a swirling effect, and/or generally turbulent movement for the air in the low pressure region, allowing it to rotate substantially about the heat sources 124 generally within the housing 102 and/or to repeatedly pass over and around the heat sources 124. The heat sources 124 generate heat which is taken up and absorbed by the air in the housing 102, the first interior wall 138, and/or any other interior portions or walls of the housing 102. In one embodiment, infrared light waves may be absorbed by the first interior wall 138 (e.g., the copper wall), causing the first interior wall 138 to function as an energy reservoir (e.g., a heat sink plate).

The function of the first interior wall 138 as an energy reservoir/heat sink may then allow the temperature of the air within the housing 102 to dramatically increase in a very short distance (e.g., within the distance of the third angled wall 136). A heater according to an embodiment of the disclosure may provide about 200 degrees F. of heat output (e.g., approximately 140 degrees F. of exhaust port differential, or heat increase for ambient 60 degree F. air). Air output from the heating assembly 100 may be about 130 cubic feet per minute. Other heat outputs are contemplated, and may not be limited to conventional or current standards of heat output. At full capacity, the heater may be capable of heating an enclosed or substantially enclosed space of about 700-1200 square feet.

It is further contemplated that the use of the first interior wall 138 as a heat sink plate may also provide retention of all or substantially all existing relative humidity for the air in the housing 102. Thus, the heat sink plate may prevent water molecules from breaking down into smaller fragments. This water molecule size retention characteristic for the heating assembly 100 may allow the heated air to remain heavier relative to air containing smaller water molecule fragments, and thus remain more effective at heating a material and/or substance the heated air contacts. In one embodiment, the air may be heated to at least approximately 180 degrees. It should be noted that the curved, first interior wall 138 may smooth and/or laminate the air flow, thus reducing turbulence and increasing the efficiency of the heating assembly 100 before the air exits through the outlet port 106 in the front wall 108.

Figure 4:
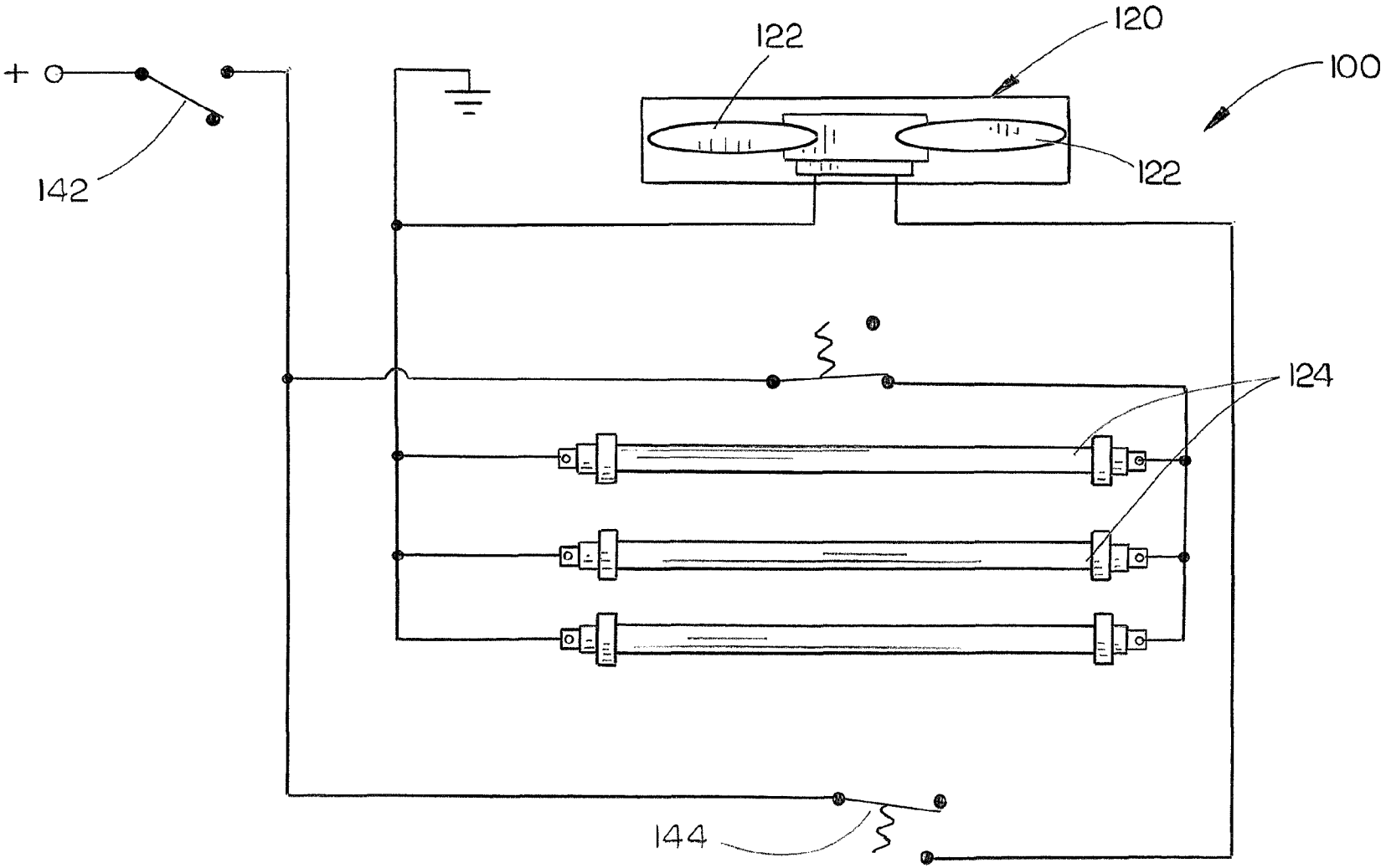
FIG. 4 is a schematic illustrating an electrical circuit for utilization with the heating assembly illustrated in FIG. 1.

Referring now to FIG. 4, an electrical circuit for the heating assembly 100 is described in accordance with the present disclosure. The fan assembly 120 and the one or more heat sources 124 may be connected to a conventional voltage source (e.g., a 120-volt source from AC mains) by means of a standard plug. An on-off switch 142 may control the activation and deactivation of the fan assembly 120 and the heat sources 124. The switch 142 (e.g., a bi-metal trip switch) and/or one or more other temperature sensing switches may sense when ambient air (i.e., air exterior to the housing 102) drops below a determined low temperature threshold (e.g., 45 degrees Celsius). The switch 142 may then initiate fan motion and/or heating of the one or more heat sources. A thermostat (not shown) may be incorporated into the electrical circuitry to automatically control the activation and deactivation of the fan assembly 120 and the heat sources 124 in response to changes in the ambient temperature.

In one implementation the fan assembly 120 and the heat sources 124 may be connected in parallel, such that when one is activated they all are activated. Alternate embodiments may include selective activation of one or more components. The heater may be grounded by a conventional mechanism. A high temperature limiting switch 144 may be disposed at any suitable location in the housing 102 and electrically connected between the power source and the switch. Thus, when the temperature in the housing 102 exceeds a predetermined level (e.g., 110 degrees Celsius), the switch may automatically terminate electrical power to the fan assembly 120 and the heat sources 124, potentially preserving and/or extending the life of the components.

In the present disclosure, the methods disclosed may be implemented as sets of instructions or software readable by a device. Further, it is understood that the specific order or hierarchy of steps in the methods disclosed are examples of exemplary approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A device, comprising:

a housing defining a generally nonlinear path between an intake port for taking in fluid and an outlet port for outputting heated fluid;

a fan assembly disposed of the intake port for supplying the intake port with the fluid;

a heat source disposed along the generally nonlinear path for heating the fluid supplied by the fan assembly; and a compression assembly for at least partially defining the generally nonlinear path, the compression assembly configured for creating a first pressure region proximal to the intake port and a second pressure region distal to the intake port, wherein the first pressure region comprises a higher fluid pressure than the second pressure region.

2. The device of claim 1, wherein the housing comprises:

a front wall including the outlet port;

a rear wall disposed opposite the front wall, the rear wall including the intake port;

a top wall at least partially connecting the front wall and the rear wall;

a bottom wall disposed opposite the top wall and at least partially connecting the front wall and the rear wall;

a first side wall at least partially connecting the front wall, the rear wall, the top wall, and the bottom wall; and a second side wall disposed opposite the first side wall and at least partially connecting the front wall, the rear wall, the top wall, and the bottom wall.

3. The device of claim 2, wherein the compression assembly comprises:

a first angled wall having a first end and a second end, the first end disposed of the rear wall and the bottom wall of the housing; and a second angled wall having a first end and a second end, the first end adjacent to and generally perpendicular to the second end of the first angled wall, and the second end disposed proximal to the bottom wall of the housing.

4. The device of claim 3, wherein the compression assembly further comprises a third angled wall having a first end and a second end, the first end adjacent to the second end of the second angled wall, and the second end disposed of the front wall and the bottom wall of the housing.

5. The device of claim 3, further comprising:

a curved interior wall coupled to the top wall of the housing and extending generally from a first vertical plane including the first end of the second angled wall to a second vertical plane including the second end of the third angled wall.

6. The device of claim 5, wherein the curved interior wall is configured to function as an energy reservoir.

7. The device of claim 1, wherein the heat source comprises a long wave red quartz infrared lamp.

8. A system, comprising:

a housing having an intake port for taking in fluid and an outlet port for outputting heated fluid;

a generally nonlinear path for fluid flow positioned between the intake port and the outlet port;

a fan assembly disposed of the intake port for supplying the intake port with the fluid;

means for heating the fluid supplied by the fan assembly; and means for at least partially defining the generally nonlinear path to create a first pressure region proximal to the intake port and a second pressure region distal to the intake port, wherein the first pressure region comprises a higher fluid pressure than the second pressure region.

9. The system of claim 8, wherein the housing comprises:

a front wall including the outlet port;

a rear wall disposed opposite the front wall, the rear wall including the intake port;

a top wall at least partially connecting the front wall and the rear wall;

a bottom wall disposed opposite the top wall and at least partially connecting the front wall and the rear wall;

a first side wall at least partially connecting the front wall, the rear wall, the top wall, and the bottom wall; and a second side wall disposed opposite the first side wall and at least partially connecting the front wall, the rear wall, the top wall, and the bottom wall.

10. The system of claim 9, wherein the defining means comprises:

a first angled wall having a first end and a second end, the first end disposed of the rear wall and the bottom wall of the housing; and a second angled wall having a first end and a second end, the first end coupled generally perpendicular to the second end of the first angled wall, and the second end disposed proximal to the bottom wall of the housing.

11. The system of claim 10, wherein the defining means further comprises a third angled wall having a first end and a second end, the first end coupled with the second end of the second angled wall, and the second end disposed of the front wall and the bottom wall of the housing.

12. The system of claim 10, further comprising:

a curved interior wall coupled to the top wall of the housing and extending generally from a first vertical plane including the first end of the second angled wall to a second vertical plane including the second end of the third angled wall.

13. The system of claim 12, wherein the curved interior wall is configured to function as an energy reservoir.

14. The system of claim 8, wherein the heating means comprises a long wave red quartz infrared lamp.

15. A method, comprising:

defining a generally nonlinear path between an intake port for taking in fluid and an outlet port for outputting heated fluid, wherein the generally nonlinear path is at least partially defined to create a first pressure region proximal to the intake port and a second pressure region distal to the intake port, the first pressure region comprising a higher fluid pressure than the second pressure region;

positioning a fan assembly at the intake port for supplying the intake port with the fluid; and positioning a heat source along the generally nonlinear path for heating the fluid supplied by the fan assembly.

16. The method of claim 15, further comprising:

positioning a front wall for defining the outlet port;

positioning a rear wall opposite the front wall, the rear wall for defining the intake port;

positioning a top wall for at least partially connecting the front wall and the rear wall;

positioning a bottom wall opposite the top wall for at least partially connecting the front wall and the rear wall;

positioning a first side wall for at least partially connecting the front wall, the rear wall, the top wall, and the bottom wall; and positioning a second side wall opposite the first side wall for at least partially connecting the front wall, the rear wall, the top wall, and the bottom wall.

17. The method of claim 16, further comprising:

positioning a first angled wall having a first end and a second end, the first end disposed of the rear wall and the bottom wall of the housing; and positioning a second angled wall having a first end and a second end, the first end coupled generally perpendicular to the second end of the first angled wall, and the second end disposed proximal to the bottom wall of the housing.

18. The method of claim 17, further comprising positioning a third angled wall having a first end and a second end, the first end coupled with the second end of the second angled wall, and the second end disposed of the front wall and the bottom wall of the housing.

19. The method of claim 17, further comprising:

positioning a curved interior wall coupled to the top wall of the housing and extending generally from a first vertical plane including the first end of the second angled wall to a second vertical plane including the second end of the third angled wall.

20. The method of claim 19, wherein the curved interior wall is configured to function as an energy reservoir.

* * * * *